US010403120B2

(12) United States Patent
Elkington

(10) Patent No.: US 10,403,120 B2
(45) Date of Patent: Sep. 3, 2019

(54) PREPROGRAMMED ELECTRONIC REMINDER DEVICE

(71) Applicant: Michael James Elkington, Scarborough (AU)

(72) Inventor: Michael James Elkington, Scarborough (AU)

( * ) Notice: Subject to any disclaimer, the term of this patent is extended or adjusted under 35 U.S.C. 154(b) by 70 days.

(21) Appl. No.: 15/638,398

(22) Filed: Jun. 30, 2017

(65) Prior Publication Data

US 2019/0005799 A1 Jan. 3, 2019

(51) Int. Cl.

| | |
|---|---|
| ***G04F 1/00*** | (2006.01) |
| ***G08B 21/24*** | (2006.01) |
| ***G08B 5/36*** | (2006.01) |
| *G04B 19/24* | (2006.01) |

(52) U.S. Cl.

CPC ..... *G08B 21/24* (2013.01); *G04F 1/005* (2013.01); *G08B 5/36* (2013.01); *G04B 19/24* (2013.01)

(58) Field of Classification Search

CPC ..... G08B 21/24
USPC ..... 340/309.7
See application file for complete search history.

(56) References Cited

U.S. PATENT DOCUMENTS 5,327,115 A * 7/1994 Swierczek ..... B42F 1/02 340/309.7
5,555,223 A * 9/1996 Barainsky ..... G04F 1/00 116/206
5,931,764 A * 8/1999 Freeman ..... G04G 9/00 361/679.03
6,320,505 B1 * 11/2001 Scott ..... G08B 21/24 206/387.15
6,337,836 B1 * 1/2002 Eidelson ..... G04F 1/005 368/10
6,392,560 B1 * 5/2002 Stuehling ..... G08B 13/1427 340/309.7
7,993,055 B2 * 8/2011 Nurse ..... G04G 13/026 368/244
8,102,735 B2 * 1/2012 Morse ..... A61J 7/0472 221/2
8,218,401 B2 * 7/2012 Wilson ..... G04F 1/005 368/108
8,966,793 B1 * 3/2015 Custren ..... G09D 3/06 116/294
10,037,679 B1 * 7/2018 Crosby ..... G08B 21/24
2002/0180591 A1 * 12/2002 Berstling ..... G08B 21/0294 340/309.16
2003/0043026 A1 * 3/2003 Noble ..... A61J 7/0472 340/309.16
2003/0089128 A1 * 5/2003 Minassian ..... A44C 5/0015 63/4
2007/0008163 A1 * 1/2007 Drake ..... G08B 21/24 340/686.1
2007/0064541 A1 * 3/2007 Kagan ..... G04F 1/005 368/108

(Continued)

*Primary Examiner* — Albert K Wong
(74) *Attorney, Agent, or Firm* — Tod A. Kupstas

(57) ABSTRACT

A preprogrammed electronic reminding device is provided with color coded light indicators that correspond to a color associated with a particular task. The device comprises of a housing, PCB and preprogrammed micro-controller. The face of device is customizable for the display of information in the way of but not limited to logos, advertising or other messages. The reminder device has a means for fastening the housing to another surface.

16 Claims, 3 Drawing Sheets

(56) References Cited

U.S. PATENT DOCUMENTS

| | | | | |
|---|---|---|---|---|
| 2007/0117464 | A1* | 5/2007 | Freeman | G06Q 10/08 439/638 |
| 2010/0271224 | A1* | 10/2010 | Varasteh | A61J 7/04 340/644 |
| 2011/0163843 | A1* | 7/2011 | Vallone | G06F 19/3462 340/5.3 |
| 2015/0256597 | A1* | 9/2015 | Gessner | G06Q 10/06 709/217 |
| 2015/0341302 | A1* | 11/2015 | Balachandran | H04L 51/24 340/815.4 |
| 2016/0379469 | A1* | 12/2016 | Flodin | G08B 21/24 340/309.7 |
| 2017/0235281 | A1* | 8/2017 | Davino | G08B 21/24 368/250 |
| 2018/0131801 | A1* | 5/2018 | Gardenfors | G06F 1/1626 |

* cited by examiner

PREPROGRAMMED ELECTRONIC REMINDER DEVICE

REFERENCE TO RELATED APPLICATIONS

The present application relates and claims priority to Australian provisional patent application No. 2016902607, filed on 2016 Jul. 2.

FIELD OF THE INVENTION

The invention relates generally to an electronic reminder device, more particularly it relates to a preprogrammed electronic reminder with color coded light indicators corresponding to the color of refuse bins due for collection in a particular period of time.

BACKGROUND OF THE INVENTION

The use of electronic reminders for short term household tasks from simply boiling an egg to operating a domestic oven with a built-in timer is commonplace. Such electronic reminders work in short term cycles, typically minutes to hours and act essentially as electronic timers.

Households tasks or events with longer cycle times such as appointments, lawn mowing or building maintenance are typically done on an as-remembered basis, which is acceptable to the home occupier as no fixed time-line exists for these to be completed. However certain household tasks with longer cycle time must be completed at specific times otherwise the window for completing the task is lost until the next cycle. A specific example of such a task is household bin or refuse container collection.

Household bin or refuse container collection typically operates on a weekly cycle requiring the home occupier to position one or more specific colored bins, on a specific day of the week, for collection by the local municipal refuse collection vehicle. Usually the local municipal authority issues a color coded refuse collection calendar detailing which colored household bins are due for collection in a specific week.

SUMMARY OF THE INVENTION

Technical Problem

The busy home occupier with multiple tasks to perform during a week may naturally forget relatively mundane task such placing the correct color bin or bins out side their property for collection either the evening before or on the morning the local municipal refuse collection vehicle arrives. Documents such as the color coded refuse collection calendar are often misplaced by the home occupier, leading them to rely on checking the color bin or bins placed by neighbours outside their respective properties. This reliance on others can lead to incorrect colored bin selection, resulting in undesirable accumulation of waste until the next time a specific colored bin is collected.

Solution to Problem

This invention is directed to an electronic reminder device that alerts the user to a specific event by visual alert signals. More specifically the electronic reminder prompts the user to complete an activity or task associated with a specific color by the flashing of an LED light of the same or similar color present on the surface of the device.

Advantageous Effects of Invention

The electronic device includes housing, power source, printed circuitry, one or more color LED lights corresponding to the colors associated with a specific activity or task and control buttons on the front face of the device.

The electronic device includes a preprogrammed MCU, which is programmed to coincide with the local area, specific activity or task.

In other embodiments the device further includes one or more of the following features: blue-tooth connectivity, motion sensor for battery/power conservation, LCD display, thermometer and solar panel.

In other embodiments the device further includes one or more fastening means on the rear face of the device and/or use of internal magnets.

In other embodiments the device has a rear housing, a stick on front fascia which incorporates any color of lens for the visual light alert needed.

BRIEF DESCRIPTION OF THE DRAWINGS

The accompanying drawing(s), which are incorporated in and constitute a part of this specification, illustrate several aspects described below.

DESCRIPTION OF THE EMBODIMENTS

It is to be understood that this invention is not limited to particular embodiments described, as such may, of course, vary. It is also to be understood that the terminology used herein is for the purpose of describing particular embodiments only, and is not intended to be limiting, since the scope of this invention will be limited only by the appended claims.

The detailed description of the invention is divided into various sections only for the reader's convenience and disclosure found in any section may be combined with that in another section. Unless defined otherwise, all technical and scientific terms used herein have the same meaning as commonly understood by one of ordinary skill in the art to which this invention belongs.

It must be noted that as used herein and in the appended claims, the singular forms "a", "an", and "the" include plural referents unless the context dearly dictates otherwise 1. Definitions Unless defined otherwise, all technical terms used herein have the same meaning as commonly understood by one of ordinary skill in the art to which this invention belongs. As used herein the following terms have the following meanings.

In the present specification and claims (if any), the word "comprising" and its derivatives including "comprises" and "comprise" include each of the stated integers but does not exclude the inclusion of one or more further integers.

Figure 3:
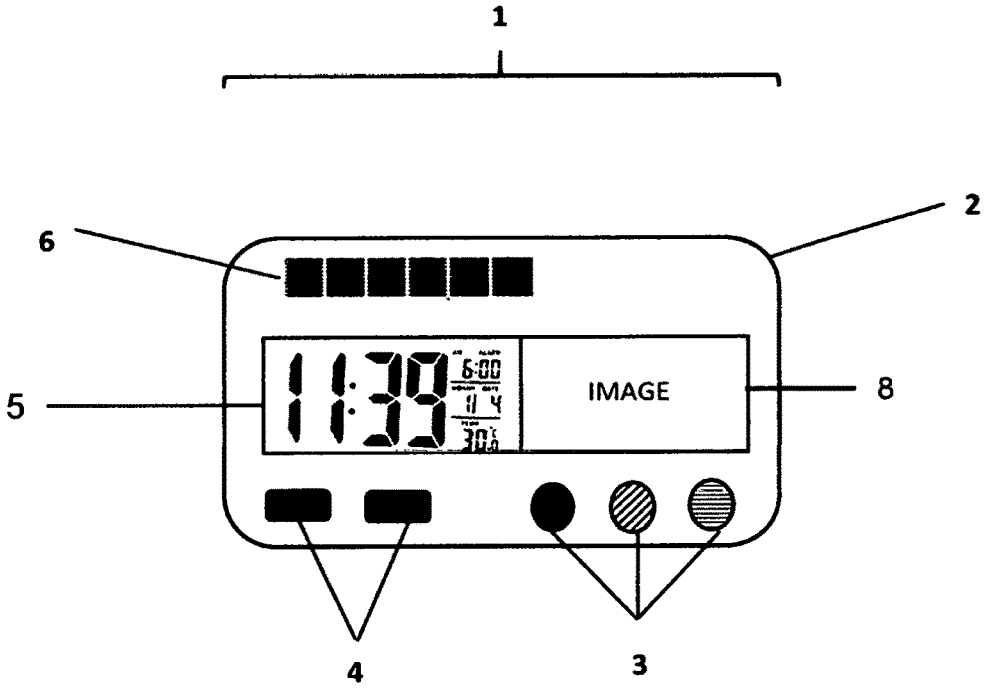
FIG. 03 is a front view of another embodiment of an electronic reminder consistent with the present invention.
Figure 4:
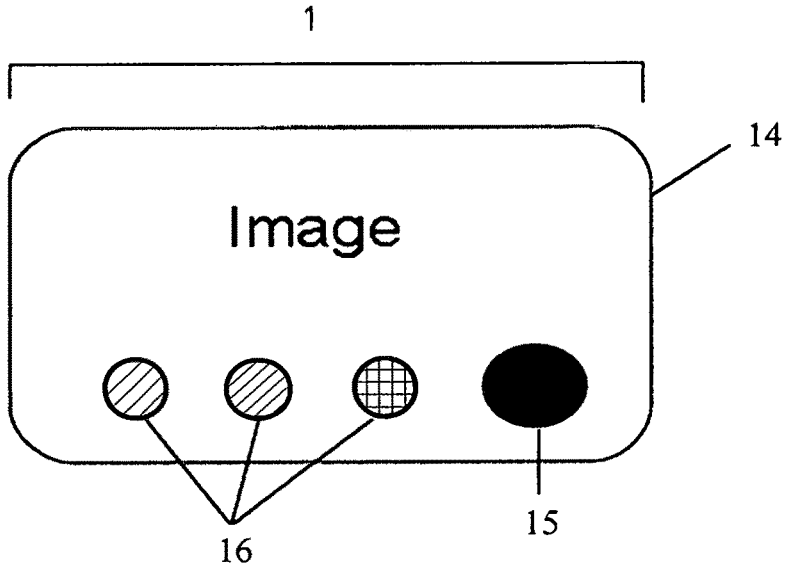
FIG. 04 is a front view of another embodiment of an electronic reminder consistent with the present invention.
Figure 5:
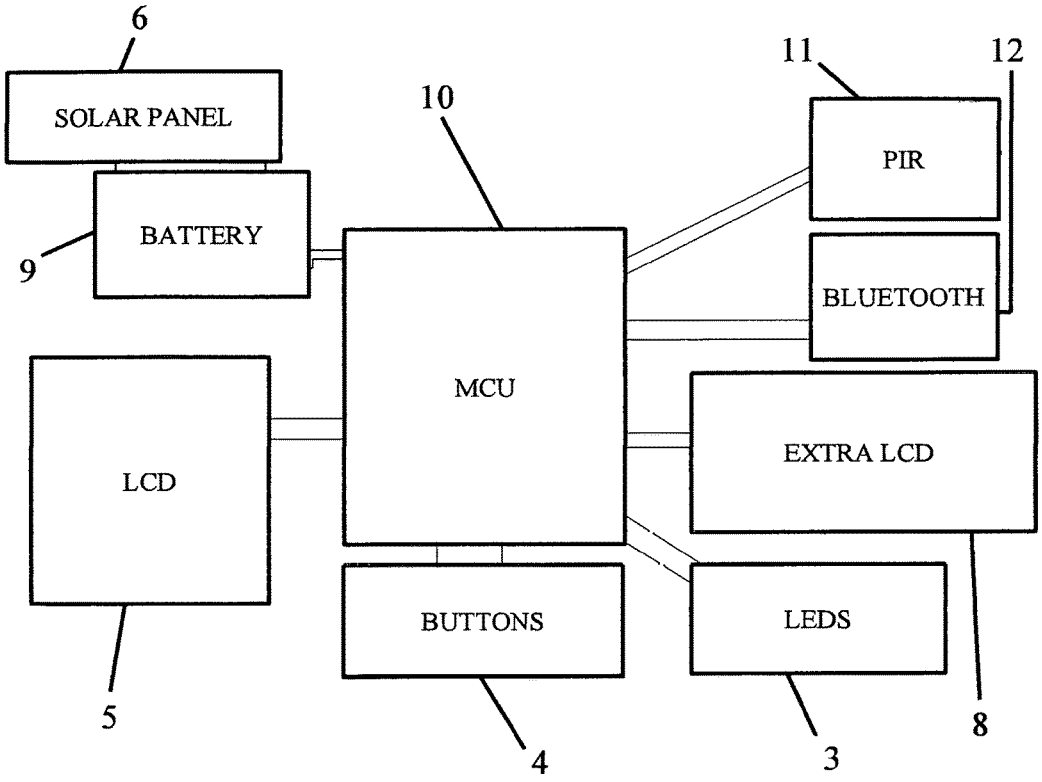
FIG. 05 is a schematic of the internal electrical components of an electronic reminder consistent with the present invention.
Figure 6:
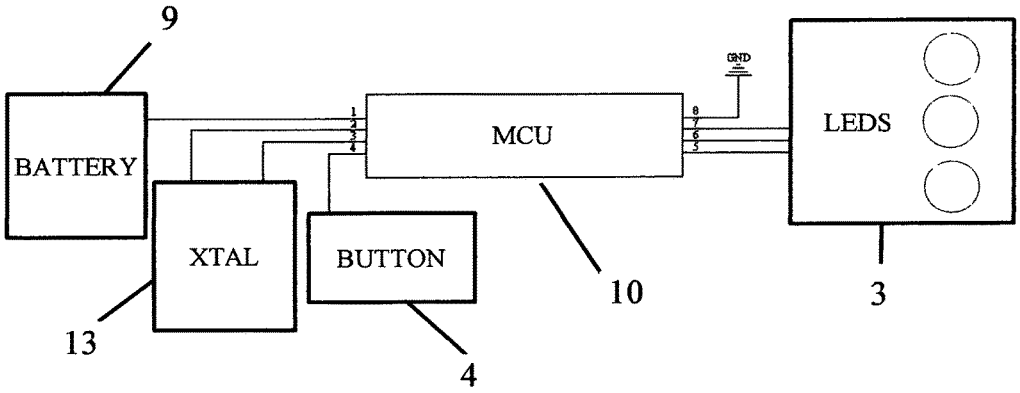
FIG. 06 is a schematic of another embodiment of the internal electrical components of an electronic reminder consistent with the present invention.

Detailed discussion of the figures: where numbers 9-14 are mentioned but not shown in FIGS. 1-4, they are internal components and therefore shown in FIG. 5-6

Figure 1:
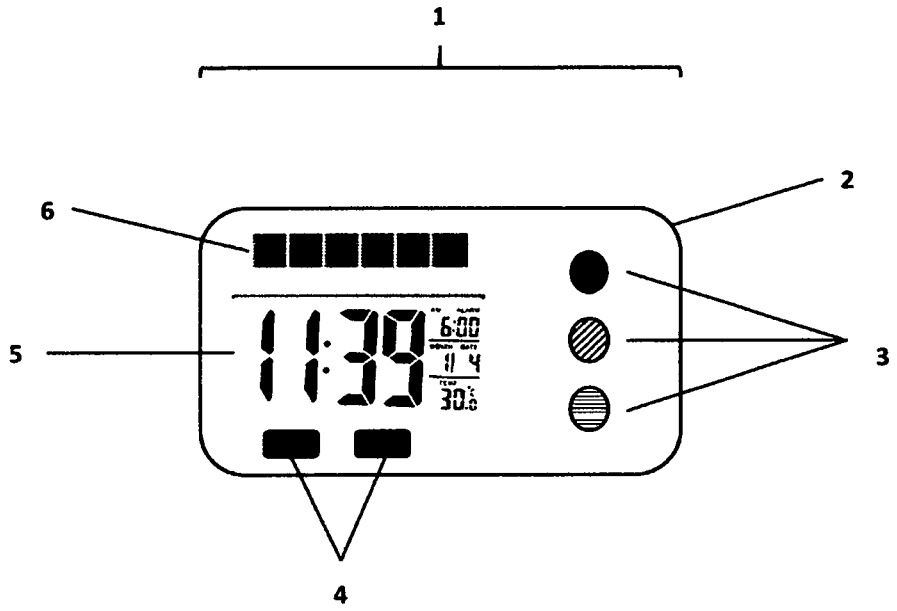
FIG. 01 is a front view of one embodiment of an electronic reminder consistent with the present invention.

With reference to FIG. 01 illustrates an exemplary embodiment of the electronic reminder device 1 comprising a housing 2 containing micro controller unit 10, printed circuitry board, back-up battery 9 and optionally bluetooth communication device 12, motion sensor 11 and thermometer. It is contemplated that the housing 2 is constructed from plastic or recycled material and may be of any shape or dimension. In the preferred embodiment the housing is a square or rectangular box.

In the exemplary configuration of the front face of the device 1 as shown in FIG. 01, three differentially colored light emitting diode (LED) lights 3 are aligned vertically. It is understood that one or more such LED lights may be used in the electronic reminder device of the present invention and may be located anywhere on the device, though its preferred they are positioned within easy view of the user on the front face of the device. Any combination of colors may be used, dearly the choice of color will be directed by the corresponding colors associated with the tasks.

For example if the user has three refuse bins: a green, brown and blue bin then the LED lights on the device will be green, brown and blue.

In the exemplary configuration of the front face of the device 1 as shown in FIG. 01, a liquid crystal display (LCD) screen 5 is positioned in a covered portion of the front face. The LCD display screen may provide the user with one or more selected from the following parameters: date, day, temperature, time and other relevant information. The date, day and time display is controlled via the use of control buttons 4. It is contemplated that one or more of such control buttons 4 are provided to select the parameters.

In the exemplary configuration of the front face of the device 1 as shown in FIG. 01, a solar panel 6 is positioned on the front face in such a suitable location to be exposed to available light in the users home or property. This in combination with a back up battery 9 held within the housing provides power to the device.

It is further contemplated that a motion sensor 11 is located within the housing 2 which provides a power saving mode wherein the reminder device 1 remains in a dormant power saving mode until motion is detected, for example by movement of an appliance or internal home door to which the reminder device 1 is attached.

Figure 2:
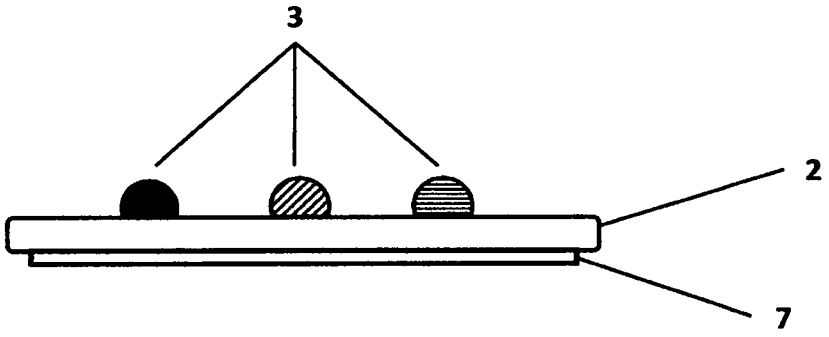
FIG. 02 is a side view of one embodiment of an electronic reminder consistent with the present invention.

With reference to an exemplary profile view shown of the reminder device 1, FIG. 02 illustrates housing 2 with a magnetic strip 7 attached to the rear face and three LED lights 3 protruding from the front face. The magnetic strip 7, affixed to the housing 2 using a suitable adhesive, enables the reminder device to be attached to a metallic device. Attachment by other means such as adhesive strips, button magnet, internal magnet, suction cups, Velcro or other suitable method known in the art may be substituted depending on the desired position of attachment.

With reference to FIG. 03 illustrates another embodiment of the electronic reminder device 1. In this embodiment an extended LCD screen 8 stretches across the front face of the device and, in addition to the parameters shown in FIG. 01, provides space for display of image data. Image data may be in the form of logos, advertisements, photos or other messages.

With reference to FIG. 04 illustrates another embodiment of the electronic reminder device 1. In this embodiment the front face of device provides space for display of logo's, advertising, pictures or other messages and may be printed directly on the face of housing 2 or a stick on fascia 14 is used that incorporates a tactile dome button 15 and coloured lenses 16 that corresponds with the color of the required task With reference to FIG. 05 illustrates the internal electronic components of the electronic reminder device 1, the internal components include:

3. LEDS, visible on external face of device with desired color coding.
4. Buttons, accessible on external face of device.
5. LCD screen,
6. Solar panel, visible on external face of the device
8. extra extended display
9. Battery, acting as back-up power source
10. MCU, micro-controller
11. PIR, passive infra-red sensor.
12. Blue-tooth receiver With reference to FIG. 06 illustrates the internal electronic components of another embodiment of the electronic reminder device 1, the internal components include:

3. L.E.Ds, light emitting diodes visible through face of device with desired color coding
4. Button, accessible on external face of device
9. Battery, acting as power source
10. M.C.U, micro-controller
13. Xtal, crystal oscillator

EXAMPLE

It is understood that the following example is not intended to limit the present invention but further aide the reader to understand the implementation of the invention.

An electronic reminder device 1 is provided with red, yellow and green LED lights 3 or lenses 16 on its front face and internal magnet for attachment to the household refrigerator. On receipt of the device the user, using control buttons 4 selects the preprogrammed sequence on which the red refuse bin, yellow refuse bin and green refuse bins are to be collected.

It is contemplated that the settings may be communicated to the device via means of a mobile phone or other mobile device application.

On the night before the red refuse bin is to be collected the red LED light flashes thus alerting the user to move the red refuse bin in a suitable location for collection by the municipal refuse collection vehicle.

More than one LED alert could go off on any week to suit local bin collection calendar.

After a set period of days the yellow LED flashes alerting the user to move the yellow refuse bin in a suitable location for collection by the municipal refuse collection vehicle.

After a set period of days the green LED flashes alerting the user to move the green refuse bin in a suitable location for collection by the municipal refuse collection vehicle.

The lights 3 will continue to flash for a set period, in a preferred embodiment this would be late morning the following day The cycle continues until it is reset using the control buttons 4 on the device.

Preprogramming will be done at the manufacturers prior to being sent to user, settings for program will be to correlate with the bin collection calendar of the local municipal area to which it's being sent.

The invention claimed is:

1. An electronic reminder apparatus comprising:

a housing having a customizable front panel;

a micro controller adapted for selecting parameters for providing indication at least one day prior to collection, wherein the microcontroller is further adapted to provide indication of which type of refuse bin is to be collected;

a plurality of light indicators, wherein the light indicators each display a different color;

one or more buttons placed on the front panel, wherein buttons are operably connected to the micro controller in order to enter input to program the micro controller to select parameters to provide indication at least one day prior to collection to an individual viewing the apparatus; and a means for fastening the housing to a surface.

2. The electronic reminder apparatus of claim 1, wherein each of the light indicators is color coded corresponding to a color of the refuse bins due for collection in a particular period of time.

3. The electronic reminder apparatus of claim 1, wherein the micro controller is adapted to activate a dormant mode, wherein the dormant mode is activated when the housing is stationary for a predetermined period of time, further wherein the dormant mode is deactivated when the housing is moved.

4. The electronic reminder apparatus of claim 1, wherein the housing is made from recycled materials.

5. The electronic reminder apparatus of claim 1, wherein the front panel further comprises an LCD screen, wherein the LCD screen is adapted to display times.

6. The electronic reminder apparatus of claim 1, further comprising an infrared sensor adapted to detect movement of the apparatus, wherein movement of the apparatus activates an LCD screen.

7. An electronic reminder apparatus comprising:

a housing having a front panel;

a preprogrammed micro controller adapted for selecting parameters for providing indication to an individual at least one day prior to collection , wherein the micro controller is further adapted to provide instructions for providing indication of which type of refuse bin is to be collected;

a plurality of light indicators located on the front panel, wherein the plurality of light indicators provide indication as to which of the refuse bins is to be collected;

a plurality of lenses of a chosen combination of color adapted change color or appearance of the plurality of light indicators;

a plurality of buttons operably connected to the preprogrammed micro controller to set a predetermined sequence of visual alerts; and a means for fastening the housing to another surface.

8. The electronic reminder apparatus of claim 7, wherein each of the plurality light indicators is color coded corresponding to the color of the refuse bin due for collection during a particular period of time.

9. The electronic reminder apparatus of claim 7 wherein the lenses are color coded corresponding to the color of the refuse bin due for collection at a predetermined time.

10. The electronic reminder apparatus of claim 7, wherein the micro controller is adapted to activate a dormant mode, wherein the dormant mode is activated when the housing is stationary for predetermined period of time, further wherein the dormant mode is deactivated when the housing is moved.

11. The electronic reminder apparatus of claim 7, wherein the housing is made from recycled materials.

12. The electronic reminder apparatus of claim 7, wherein the front panel further comprises an LCD screen, wherein the LCD screen adapted to display times.

13. The electronic reminder apparatus of claim 7, further comprising an infrared sensor adapted to detect movement of the apparatus, wherein movement of the apparatus activates an LCD screen.

14. A method of indicating which refuse bin is to be collected, the method comprising:

programming a microcontroller located within a housing to select parameters for providing indication of which refuse bin is to be collected at least one day prior to collection, wherein the housing has a front panel, wherein indication of which refuse bin is to be collected at least one day prior to collection is provided by a plurality of light indicators located on the front panel, wherein each of the plurality of light indicators is adapted to change color using a plurality of lenses having a predetermined combination of color to change the color;

activating one of plurality of light indicators at least one day prior to when a first refuse bin is to be collected, wherein the first refuse bin is for one type of refuse;

activating another one of the plurality of light indicators at least one day prior to when a second refuse bin is to be collected, wherein the second refuse bin is for another type of refuse than the first refuse bin; and activating yet another one of the plurality of light indicators at least one day prior to when a third refuse bin is to be collected, wherein the third refuse bin is for yet another type of refuse than either or the first refuse bin or the second refuse bin.

15. The method of claim 14, removably attaching the housing to a movable object, wherein movement of the movable object activates one of the plurality of light indicators, wherein non-movement of the movable object activates a dormant mode.

16. The method of claim 15, wherein the movable object is a door.

* * * * *